US011969664B2

(12) United States Patent
Schou et al.

(10) Patent No.: US 11,969,664 B2
(45) Date of Patent: Apr. 30, 2024

(54) USER CONFIGURABLE INTERACTIVE TOY

(71) Applicant: LEGO A/S, Billund (DK)

(72) Inventors: Anders Antoft Schou, Vejle (DK); Jonathan B. Bennink, Billund (DK); Amelia Bennett, Billund (DK); Steven Geist, Billund (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 18/040,879

(22) PCT Filed: Sep. 13, 2021

(86) PCT No.: PCT/EP2021/075037
§ 371 (c)(1),
(2) Date: Feb. 7, 2023

(87) PCT Pub. No.: WO2022/053662
PCT Pub. Date: Mar. 17, 2022

(65) Prior Publication Data

US 2023/0338865 A1 Oct. 26, 2023

Related U.S. Application Data

(63) Continuation-in-part of application No. 17/764,610, filed as application No. PCT/EP2020/076257 on Sep. 21, 2020.

(30) Foreign Application Priority Data

Sep. 11, 2020 (DK) ..... PA 2020 70589

(51) Int. Cl.
*A63H 17/32* (2006.01)
*A63H 3/28* (2006.01)
(Continued)

(52) U.S. Cl.
CPC ..... *A63H 17/32* (2013.01); *A63H 3/28* (2013.01); *A63H 13/005* (2013.01);
(Continued)

(58) Field of Classification Search
CPC .. A63H 33/042; A63H 2200/00; A63H 33/26; G06K 17/0025; G06K 17/0029; G06F 3/0488
See application file for complete search history.

(56) References Cited

U.S. PATENT DOCUMENTS 5,913,727 A 6/1999 Ahdoot
6,165,068 A 12/2000 Sonoda et al.
(Continued)

FOREIGN PATENT DOCUMENTS

JP 2011130829 A2 7/2011
WO 2000/079403 A2 12/2000
(Continued)

OTHER PUBLICATIONS

CN Office Action corresponding to U.S. Appl. No. 17/764,610, dated Sep. 8, 2023, 6 pages (translation unavailable).
(Continued)

*Primary Examiner* — Nini F Legesse
(74) *Attorney, Agent, or Firm* — Day Pitney LLP; Anthony A. Kassas

(57) ABSTRACT

An interactive toy including a reader for detecting a marker in a proximity of the interactive toy. The interactive toy also has a sensor for detecting movement of the interactive toy and a memory having programmed instructions and configuration data thereon. The programmed instructions are configured to control a response of the interactive toy to a detection of the marker, the response being defined at least in part by the configuration data. The interactive toy also has a processing unit configured to execute the programmed
(Continued)

instructions according to the configuration data when the processing unit is in a play state. The processing unit is further configured to modify the configuration data in response to a combination of a detection of the marker in a proximity of the interactive toy, and a detection of a movement of the interactive toy when the processing unit is in a configuration state.

17 Claims, 4 Drawing Sheets

(51) Int. Cl.
*A63H 13/00* (2006.01)
*A63H 33/04* (2006.01)
*A63H 33/08* (2006.01)

(52) U.S. Cl.
CPC ..... *A63H 33/042* (2013.01); *A63H 33/086* (2013.01); *A63H 2200/00* (2013.01)

(56) References Cited

U.S. PATENT DOCUMENTS 6,213,872 B1 4/2001 Harada et al.
6,257,948 B1 7/2001 Silva
6,290,565 B1 9/2001 Galyean et al.
6,443,796 B1 * 9/2002 Shackelford ..... A63H 33/086 273/237
6,551,165 B2 4/2003 Smirnov
6,761,637 B2 7/2004 Weston et al.
6,834,249 B2 12/2004 Orchard
7,066,781 B2 6/2006 Weston
8,232,879 B2 7/2012 Davis
8,681,005 B2 3/2014 Austin et al.
8,845,384 B2 9/2014 Ghaly
8,876,604 B2 11/2014 Casino et al.
9,259,651 B1 2/2016 Yano
9,333,427 B2 5/2016 Sabo et al.
9,542,579 B2 1/2017 Mangold et al.
9,757,624 B2 9/2017 Binder
10,625,173 B2 * 4/2020 Kærsgaard ..... A63H 33/086
2002/0193160 A1 12/2002 Tarantino
2004/0214642 A1 10/2004 Beck
2005/0208458 A1 9/2005 Smith et al.
2008/0014830 A1 1/2008 Sosnovskiy et al.
2008/0081694 A1 * 4/2008 Hong ..... A63F 13/80 463/34
2008/0139080 A1 * 6/2008 Zheng ..... A63H 3/28 446/268
2008/0153594 A1 6/2008 Zheng
2011/0053173 A1 * 3/2011 Hood ..... G07F 17/3202 435/7.1
2012/0218299 A1 8/2012 Hayakawa
2014/0273721 A1 9/2014 Katan et al.
2015/0290545 A1 * 10/2015 Barney ..... A63F 13/21 463/31
2015/0325079 A1 11/2015 Alsip
2016/0029962 A1 * 2/2016 Hyde ..... A61B 5/1171 600/300
2017/0018980 A1 1/2017 Yang et al.
2017/0113131 A1 4/2017 Doptis et al.
2017/0144083 A1 5/2017 Kærsgaard et al.
2019/0009181 A1 1/2019 Kroyan et al.
2019/0209932 A1 7/2019 Schwartz et al.

FOREIGN PATENT DOCUMENTS

WO 2003043709 A1 5/2003
WO 2017100821 A1 6/2017
WO 2018215740 A2 11/2018
WO 2020001789 A1 1/2020
WO 2020156719 A1 8/2020
WO 2020156720 A1 8/2020

OTHER PUBLICATIONS

DK Search Report in Application No. PA 2020 70589, Completion of Search Report dated Mar. 10, 2021, 4 pages.
International Search Report issued in corresponding international patent applicaton No. PCT/EP2020/076257, dated Nov. 25, 2020, 4 pages.
Search Report issued in corresponding Danish patent application No. PA 2019 70608, dated Mar. 4, 2020, 4 pages.
Written Opinion of the ISA issued in corresponding international patent application No. PCT/EP2020/076257, dated Nov. 25, 2020, 5 pages.
International Search Report in International Application No. PCT/EP2021/075037, dated Jan. 4, 2022, 3 pages.
Written Opinion in International Application No. PCT/EP2021/075037, dated Jan. 4, 2022, 7 pages.

* cited by examiner

USER CONFIGURABLE INTERACTIVE TOY

CROSS-REFERENCE TO RELATED APPLICATIONS

The present application is a U.S. National Stage Application of International Application No. PCT/EP2021/075037, filed on Sep. 13, 2021 and published on Mar. 17, 2022 as WO 20221053662 A1, which claims the benefit and priority of Danish Patent Application No. 202070589, filed on Sep. 11, 2020, each of which is incorporated herein by reference in its entirety for any purpose whatsoever.

The present application is also a Continuation-in-Part of U.S. patent application Ser. No. 17/764,610, filed Mar. 29, 2022 and published on Nov. 10, 2022 as U.S. Patent Publication No. 2022/0355218 A1, which is a U.S. National Stage Application of International Application No. PCT/EP2020.076257, filed on Sep. 21, 2020 and published on Apr. 8, 2021 as WO 2021/063721 A1, which claims the benefit and priority of Danish Patent Application No. 201970608, filed on Sep. 30, 2019, each of which is incorporated herein by reference in its entirety for any purpose whatsoever.

FIELD OF THE DISCLOSURE

The present disclosure relates in one aspect to a user-configurable interactive toy facilitating interactive play. According to a particular aspect, the disclosure relates to a user-configurable interactive toy that is adapted to interact with objects in a physical play environment according to programmed instructions. In a further aspect, the disclosure relates to a toy system including such a user-configurable interactive toy and objects it can interact with. In a yet further aspect, the disclosure relates to a method of configuring such a user-configurable interactive toy and toy system.

BACKGROUND

Many interactive toys are known in the art.

WO 03/043709 discloses a toy or game play apparatus or method involving a powered host or master unit which operates interactively with one or more non-self-powered play objects. The host has a pre-programed microcontroller and an RFID reader/interrogator circuit. Each play object has a RFID tag IC. When the host and a play object are positioned so as to afford RF communication between them, the host sends power to energize the tag IC of the play object. The host recognizes that transmitted data and makes a presentation to the user caused by that transmitted data. Some or even all of the presentation may be the data from the play object.

Nevertheless, it generally remains desirable to provide interactive toys that provide a variety of entertaining play experiences.

It is further generally desirable to provide interactive toys at relatively low costs.

It is further desirable to provide an interactive toy that provides an easy-to-use, yet entertaining and versatile interaction with the interactive toy.

Yet further, it is desirable to provide an interactive toy that can be configured and reconfigured by the user to allow for a variety of different play experiences using the same elements. In particular, it is desirable to facilitate an easy way of configuring the interactive toy with respect to objects it can interact with.

SUMMARY

In one aspect, the object of the disclosure is achieved by an interactive toy as defined in the attached independent claim 1 with advantageous embodiments of the interactive toy and a toy system according to the dependent claims referring to it. In a further aspect, a configuration device for use when configuring the interactive toy is disclosed in the attached independent claim 15 with advantageous embodiments according to the dependent claims referring to it. The object of the disclosure is further achieved by a method of configuring an interactive toy with advantageous embodiments as disclosed herein.

According to one aspect, embodiments of an interactive toy are disclosed, the interactive toy comprising: a reader for detecting a marker in a proximity of the interactive toy; a sensor for detecting movement of the interactive toy; a memory comprising programmed instructions and configuration data, wherein the programmed instructions are configured to control a response of the interactive toy to a detection of the marker, the response being defined at least in part by the configuration data; and a processing unit configured to execute the programmed instructions according to the configuration data when the processing unit is in a play state; wherein the processing unit is further configured to modify the configuration data in response to a combination of a detection of the marker in a proximity of the interactive toy, and a detection of a movement of the interactive toy when the processing unit is in a configuration state. In particular, the processing unit is configured to modify the configuration data in response to a combination of a reader signal from the reader, the reader signal being indicative of a detection of the marker in a proximity of the interactive toy, and a sensor signal from the sensor, the sensor signal being indicative of a detection of a movement of the interactive toy when the processing unit is in a configuration state.

The interactive toy is a user-configurable interactive toy capable of detecting user interactions by detecting movements with a movement sensor and by detecting markers when the interactive toy and the markers are brought in proximity of each other. The sensor data from the movement sensor and from the reader are processed by the processing unit according to programmed instructions and configuration data stored in the memory of the interactive toy. The programmed instructions define an interaction output of the interactive toy based on the sensor data from the movement sensor and the reader. The processing unit may thus provide an interaction output responsive to a detected movement and a detected marker, according to the programmed instructions. The configuration data define at least in part the response of the interactive toy to a detection of the marker when the processing unit of the interactive toy is in the play state. By modifying the configuration data through playful physical interaction with the toy and the marker when the interactive toy is in a configuration state, a user may configure the response of the interactive toy for a playing context. The response of the interactive toy to the detection of the marker when the interactive toy is in the play state may thus be modified by the user in a simple manner, by playfully interacting with the interactive toy in the configuration state. Thereby a simple and playfully interactive user interface for configuring the interactive toy is provided.

The sensor for detecting movement may be an accelerometer or other suitable device for detecting accelerations, vibrations, and/or other indicators of a movement of the electronic device. In some embodiments, the sensor comprises a multi-axes accelerometer, such as a triaxial accelerometer or a 6-axis accelerometer.

The reader may be a near field communication reader, an RFID reader, an electromagnetic reader, a machine vision system or other optical sensor for reading bar codes or QR codes, detecting colours, reading colour codes, reading micro-dot patterns and/or the like.

The reader is for detecting a marker of an interactive toy system. The marker element is associated with or representative of a response of the interactive toy to a detection of/interaction with the marker element according to at least one of the programmed instructions, when the interactive toy is in an active play state. Examples of markers for use in an interactive play experience may be power blocks conveying special skills or powers when detected by the interactive toy in the course of an interactive play activity. Detecting markers may also cause the interactive toy representing a playable character to earn or loose resources, coins, gems, or similar in-game currencies, add or reduce available playing time for completing a task or mission, change a pace of a game, change a general state of the playable character, or the like. By performing a configuration of the interactive toy in respect of the marker one may "configure the marker" to different values. e.g. a marker representing a treasure chest may be configured to contain a certain amount of coins, a resource marker may be configured to provide different types of resources, or a joker marker may be configured to produce a random result, or to play a trick on the interactive toy going into a trap when detecting the marker, etc.

As mentioned above, examples for suitable sensors for detecting movement are a gyroscope, accelerometer, or similar motion detection sensor adapted to detect movement of the interactive toy with respect to surroundings considered as an inertial reference frame, e.g. by measuring effects of forces acting on the interactive toy in said inertial reference frame. However, in some embodiments a sensor for detecting a movement of the interactive toy with respect to another element considered as reference element may be used, wherein such a sensor is adapted to detect the relative movement of the interactive toy with respect to the other element. For example, the reference element may be an indexing scale or pattern detectable by the sensor.

Thereby it is achieved that a movement may also be detected when the interactive toy stays at rest with respect to the surroundings, but the other element acting as reference element is actually moved with respect to the interactive toy. In some embodiments, the reader may also act as a sensor, provided that the reader is also configured to provide a signal indicative of a movement of the interactive toy as discussed above, e.g. if the reader is adapted to perform an orientation or displacement sensitive detection (electrical, magnetic, optical, such as non-imaging or imaging or machine-vision). In some embodiments, the movement may be conceived to be detected with respect to the marker also acting as a reference element.

The memory may include an EEPROM, a RAM, a solid-state data storage device or another suitable data storage device.

The processing unit may include a suitably programmed microprocessor or any other circuit and/or device suitably adapted to perform the data- and/or signal-processing functions described herein. In particular, the processing unit may comprise a general- or special-purpose programmable microprocessor, such as a central processing unit (CPU), a digital signal processing unit (DSP), an application specific integrated circuits (ASIC), a programmable logic arrays (PLA), a field programmable gate array (FPGA), a special purpose electronic circuit, etc., or a combination thereof.

The processing unit is configured to execute the programmed instructions according to the configuration data when the processing unit is in a play state, thereby controlling the behaviour of the interactive toy in a playing context, including the response of the interactive toy to the detection of the marker in the play state. The processing unit is further configured to modify the configuration data in response to a combination of a detection of the marker in a proximity of the interactive toy, and a detection of a movement of the interactive toy when the processing unit is in the configuration state. Thereby, the configuration data, which defines at least in part the behaviour of the interactive toy in the play state, may be modified in a playfully interactive manner when the processing unit is in the configuration state. Thereby a simple and playfully interactive user interface for configuring the interactive toy is provided as also discussed above.

The interactive toy may comprise a housing accommodating the reader, the sensor, the memory, and the processing unit. For example, the housing may have a shape representing a character.

The interactive toy is operable in at least a play state and a configuration state. At least the programmed instructions in respect of the interaction response in a play state may be configured. When the interactive toy is in an active play state, the response of the interactive toy to interactions detected by the movement sensor and by the reader defines the behaviour of the interactive toy in a play activity, and is reflected in the interaction output provided by the processing unit in response thereto.

The interaction output results from the execution of the programmed instructions relating to an active play state in the processing unit, responsive to any of the detected interactions alone or in combination. The interaction output may be converted into user-perceptible output in real time or may be stored for conversion into user-perceptible output at a later time. Advantageously, at least some of the interaction output is converted into user-perceptible output in real time in order to provide an interactive play experience with an immediate feedback to the user. The user perceptible output may be presented in any suitable manner. For example, the user perceptible output may be presented directly through a user interface of the interactive toy. Alternative or in addition thereto, the user perceptible output may be presented through the proxy of an external device, such as a mobile phone, a tablet, a computer, a smart TV, an active loudspeaker, a headset, a head mountable display or the like, which may be connected, wired or wireless, to the interactive toy through a suitable digital or analogue communications interface.

When the interactive toy is in a configuration state, the response of the interactive toy to interactions detected by the movement sensor and by the reader configures the behaviour, which the interactive toy will exhibit in a play activity in response to the detection of movements and to the detection of markers as described above. The configuration is reflected in the configuration data defining, at least in part, the interaction response in a play state as described above.

Configuration includes, for example, setting parameter values of parameters used by stored programmed instructions, and/or setting values indicative of a selection from stored programmed instructions, thereby modifying the behaviour of the interactive toy in a given play activity. Configuration may also include selecting and retrieving one or more programmed instructions from a plurality of programmed instructions or selecting and retrieving a sub-set of programmed instructions from a plurality of preconfigured sub-sets of programmed instructions.

The configuration of the interactive toy may be provided as configuration data used as input during execution of the programmed instructions in the play state and/or as set of programmed instructions that has been pre-configured based on the configuration data for execution by the processing unit when the interactive toy is in the active play state. The configurable programed instructions are typically programed beforehand, i.e. pre-programed, and stored in the memory of the interactive toy and/or may be retrievable through a wired or wireless communications interface from an external source, such as from a local computing device connected to the electronic device, or from a network based service.

Thereby a configuration user interface is provided that utilizes the same interaction detectors, which are used to provide a rich interactive play experience to a user playing with the interactive toy.

By providing a configuration user interface and process utilizing components that are also required and useful for the interactive play activities that can be performed with the interactive toy and the toy system, it is achieved that the configuration user interface can be operated in a playfully interactive and intuitive manner by the user typically also playing with the toy. The educational and play-value of the interactive toy and of the toy system including such an interactive toy is therefore significantly enhanced by the configuration user interface, since the user her/himself may define and modify the behaviour of the interactive toy and of the toy system, and thus construct a large variety of new play activities.

Further according to some embodiments of the interactive toy, the marker and the movement are detected within a pre-determined temporal relation with respect to each other. The combined detection of the marker and of the movement may e.g. occur at the same time, or at least during overlapping periods of time. The detection of the marker and the detection of the movement may also occur separate in time, but falling within a pre-determined time interval of each other and/or in a pre-determined sequence of each other, in order to be associated with each other as a combined detection. Thereby a large flexibility is achieved for the implementation of the combined detection of the marker and movement.

Further according to some embodiments of the interactive toy, the marker and the movement are detected concurrently, i.e. detection of the marker and of the movement occur at least during overlapping periods of time. Thereby a clear and precise association of the two detection events with each other is achieved.

Further according to some embodiments, the interactive toy further comprises a user-interface for providing a user-perceptible output, wherein the processing unit is further configured to control the user-interface responsive to a detected movement and a detected marker. The user-interface may include a display and/or a loudspeaker, and/or other devices for providing user-perceptible output, in particular visible, audible and/or tactile output.

By providing a user-interface on the electronic to produce user-perceptible output that is controlled by the processing unit in response to movements detected by the movement sensor and markers detected by the reader, a direct and immediate feedback to the user interactions can be provided, thereby improving the interactive experience when using the toy. Furthermore, by providing a user-interface adapted to produce direct feedback to user interactions, the interactive toy may be used in a self-consistent manner in the toy system, independent of external devices. This particularly enhances the play experience when the interactive toy is shaped as a figurine for representing a playable character in a play activity, since the feedback to user interaction is directly provided by the interactive toy, and may therefore more naturally be associated with said playable character represented by the figurine.

Furthermore, when the processing unit is operated in a configuration state, the user interface may me controlled to provide user-perceptible output giving feedback on the configuration activities performed through physical interactions with the interactive toy. Thereby a natural sensory interaction with the interactive toy for performing the configuration process is provided. The user is thus provided with a further enhanced intuitive and playful configuration user interface for customizing the interactive behaviour of the interactive toy in response to physical interactions and markers during a play activity.

Further according to some embodiments of the interactive toy, the processing unit is configured to:

enter a configuration state responsive to a first trigger event indicative of a start of a configuration activity;

exit the configuration state responsive to a second trigger event indicative of an end of a configuration activity; and process information about movements detected by the sensor while the processing unit is in the configuration state and/or information about markers detected by the reader while the processing unit is in the configuration state, to determine a configuration input and modify the configuration data based on the determined configuration input.

To allow for configuration of the interactive toy, the processing unit is triggered to enter a configuration state. Advantageously, the trigger is an event related to a user interaction indicating the user's intend to configure the interactive toy. To end configuration the processing unit is triggered to exit the configuration state. Advantageously, the trigger is an event related to a user interaction indicating the user's intend to stop configuring the interactive toy. It will be appreciated that, in some embodiments, the configuration activity may be started by the user activating a user-interface element and ended by reading a corresponding marker. Alternatively, the configuration activity may be started by reading a marker and ended by the user activating a user-interface element. Similarly, the start and end of the configuration activity may be triggered by respective activation of a single user-interface element. e.g. by repeated pressing a button, where the first activation starts the configuration activity and a second, subsequent activation ends the configuration activity. Alternatively, the interactive toy may include separate user-interface elements for starting and ending the configuration activity, respectively.

In the configuration state the user may interact with the interactive toy to perform pre-determined movements, which are recognized by the processing unit, and interpreted as a configuration gesture determining a specific configuration input. In a particularly advantageous embodiment, the pre-determined movement is a rotation around a pre-determined rotation axis, such as a principal axis of the interactive toy, e.g. for dialling through a set of different configuration settings, parameter values, or the like.

Configuration is typically in relation to a marker element defining or otherwise associated with a play activity. To that end, the marker element(s) for which the interactive toy is to be configured with regard to the interaction response in said play activity is therefore also detected in combination with the above-described configuration gestures, such as simultaneously or otherwise in a temporal relation. In some embodiments, the processing unit is thus configured to control the configuration interface responsive to a detected movement and a detected marker, wherein the movement and the marker are detected to have a predetermined temporal relation with each other, such as detected concurrently, within a predetermined time period, in a predetermined sequential order, etc. or a combination thereof. Alternatively or additionally, the determined configuration input may depend on a detected predetermined temporal relation of the detection of a marker and the detection of a movement with each other, such as detected concurrently, within a predetermined time period, in a predetermined sequential order, etc. or a combination thereof.

Further according to some embodiments of the interactive toy, the first trigger event includes detection by the reader of a marker element, when the interactive toy is in a predetermined operational state. Preferably, the marker element is a marker element representative of a configurable response of the interactive toy according to at least one of the programmed instructions. By requiring a pre-determined operational state of the interactive toy and, correlated with this pre-determined operational state, the detection of a marker, the processing unit may infer the intention to configure the interactive toy, typically with respect to the detected marker. The processing unit may register this as a first trigger event and as a consequence enter the configuration state.

Advantageously, the pre-determined state is not one of the play-states, i.e. a non-play state, and inherently not the configuration state to be entered. For example, the predetermined state may be a so-called idle state, sleep-state, or stand-by state, or a general initialization state of the interactive toy. The pre-determined state may, for example, be a state entered upon power-up, immediately prior to entering a play state, when starting a new play activity, or after leaving a play session, or may be entered in response to a dedicated user gesture performed by moving the interactive toy (such as a rapid shaking gesture) and detecting said gesture movement by the movement sensor.

Further according to some embodiments of the interactive toy, the first trigger event includes a change in detection status between detecting and not detecting a marker element. Advantageously, the change in detection status indicating a first trigger event is a change from NOT detecting to detecting a marker. Further according to some embodiments of the interactive toy, the second trigger event includes a change in detection status between detecting and not detecting a marker element. Advantageously, the change in detection status indicating a second trigger event is a change from detecting to not detecting a marker. Further advantageously, the change in detection status indicating a first trigger event is a change from not detecting to detecting a marker and the change in detection status indicating a second trigger event is a change from detecting to not detecting a marker.

It is further conceivable that the interactive toy comprises one or more user-interface elements; and the processing unit is configured to enter the configuration state responsive to a first user-activation of at least one of the one or more user-interface elements; the first user-activation being indicative of a start of a configuration activity; and/or to exit the configuration state responsive to detecting a second user-activation of at least one of the one or more user-interface elements, the second user-activation being indicative of an end of a configuration activity. While conceivable, and in some embodiments even advantageous, such a user interface element is not strictly necessary in order to trigger the interactive toy to enter and/or exit the configuration state. This is one advantage of the disclosure. In fact according to some embodiments, no specific user-interface elements for receiving configuration input from a user are provided.

Advantageously according to some embodiments of the interactive toy, processing information about movements detected by the sensor includes identifying a pre-determined motion pattern and provide a configured set of programmed instructions according to the identified motion pattern. Accordingly, the detected movement may include a motion pattern, e.g. a rotation, tilt, vibration and/or the like. The processing unit may process the detected signals from the sensor for detecting movement so as to determine one or more attributes of the movement, such as one or more frequencies of a vibration, an amplitude of a vibration, a speed of movement, an orientation of a rotation, etc. The processing unit may base the control of the configuration interface on the determined attribute.

Further according to some embodiments of the interactive toy, the detected movement is a rotation and processing information about movements detected by the sensor includes identifying a rotation about a pre-determined rotation axis by a rotation angle associated with a configuration setting. For example, a selection of configuration settings may be inferred from a rotation angle covered by the movement falling within one of one or more pre-determined ranges, each range being associated with a different configuration setting.

Advantageously according to some embodiments of the interactive toy, the detected movement is a translation and processing information about movements detected by the sensor includes identifying a translation along a pre-determined path by a translation distance associated with a configuration setting. For example, a selection of configuration settings may be inferred from a translation distance falling within one of one or more pre-determined ranges, each range being associated with a different configuration setting. It will further be appreciated that any combination of movements, such as a combination of rotational and translational movement components may also be analysed by the processing unit to infer a configuration setting.

Further according to some embodiments of the interactive toy, modifying the configuration data includes one or more of: setting a parameter value for/in a programmed instruction; retrieving one or more selected programmed instructions, e.g. from programmed instructions stored in the memory of the interactive toy, or from programmed instructions stored in an external storage medium accessible through a communications interface in the interactive toy; and retrieving a sub-set of programmed instructions from a plurality of pre-configured sub-sets of programmed instructions stored in the memory of the interactive toy. Sub-sets are e.g. combinations of a plurality of programmed instructions selected from a set of programmed instructions. Different sub-sets may comprise overlapping instructions as long as they differ in at least one of the selected programmed instructions and/or in at least a parameter setting. Each of the plurality of programmed instructions that may be selected may correspond to a respective response of the interactive toy to the detection of the marker when the processing unit is in the play state. Each of the plurality of sub-sets may in combination define a respective behaviour of the interactive toy when the processing unit is in the play state. The term behaviour of the interactive toy refers here to a predetermined set of responses. Typically, a predetermined set of responses may define one or more of: a particular type of game play, such as a race game, arcade game, free play, an educational game, a board game, or the like; a mood of the interactive toy; a playable character physically impersonated by the interactive toy, a particular state of the playable character, such as a superpower state, or the like.

Further according to some embodiments of the interactive toy, modifying the configuration data provides modified configuration data, thereby modifying the response of the interactive toy to a detection of the marker when the processing unit is in the play state.

According to a further aspect, a toy system is disclosed, the toy system comprising one or more interactive toys according to any of the embodiments disclosed herein, and one or more marker elements adapted to be detected by at least one of the readers of the one or more interactive toys.

The interactive toy may thus be part of a toy system, the toy system including the interactive toy and accessories to the interactive toy, such as clothing, tools, weapons, etc. that can be removable attached to the interactive toy. In some embodiments, the interactive toy may be configured to detect and recognize one or more of the accessories when the accessory is attached to the interactive toy. To this end the accessories may comprise respective markers identifying the interactive toy. Alternatively, the interactive toy may be configured to otherwise detect attachment of an accessory, e.g. by mechanical activation of one or more switches, by electrical contact, by RFID or other contactless technology, etc.

Further according to some embodiments, the toy system is a toy construction system, wherein the one or more interactive toys and the one or more marker elements are toy construction elements of the toy construction system.

In some embodiments, the interactive toy may thus be a toy construction element compatible with a toy construction system. In particular, the interactive toy may comprise coupling members configured for detachable attachment to other toy construction elements of the toy construction system. For example, the toy construction system may include accessories that can be detachably attached to the interactive toy by means of said coupling members.

In some embodiments, the toy construction system thus further comprises marker construction elements. The marker construction elements may each comprise coupling members for detachable attachment to other toy construction elements of the toy construction system, and the marker construction elements may be detectable and recognizable by the reader. To this end, and depending on the type of reader, the marker construction elements may include an RFID tag and/or a visually detectable feature such as a bar code or QR code, a predetermined colour, a colour code, a micro-dot pattern, a recognizable insignia, etc. in other embodiments other forms of markers may be used e.g. adhesive stickers or other physical markers that can be attached, preferably in a detachable manner, to a toy construction element.

Hence, the toy construction system may be configured to allow the user to construct one or more toy construction models, each comprising one or more markers, e.g. one or more marker construction elements. The user may thus construct an arena, track or other physical play environment. During game play, the user may move the interactive toy about the thus constructed physical play environment and the interactive toy may detect one or more of the markers, when the interactive toy is brought into sufficient proximity of the markers. The interactive toy may further detect its own movements and provide user-perceptible outputs based on the detected movements and detected markers. Thereby a highly flexible interactive toy construction system is provided allowing for the construction of a large variety of interactive play experiences combining mechanical construction play with electronic and physical interactive game play, wherein the flexibility and variety of the toy system is yet further enhanced by facilitating an interactive configuration and re-configuration by a user of the toy system of the interactive responses of the interactive toy with respect to different movements and in respect of different markers.

Further according to some embodiments, the toy system comprises at least a first interactive toy and a second interactive toy, each comprising a communications interface, wherein the first and second interactive toys are adapted to communicate with each other via their respective communication interfaces.

It will be appreciated that the communication may be established in any suitable manner, such as directly or via a networked infrastructure, wired or wireless. The communication between multiple interactive toys allows for building a multiplayer interactive play environment, which may be constructed, configured and re-configured by the users of the toy system analogue to what has been described above.

For example, in a level game play the communication interface may be used to share level data amongst the different interactive toys, wherein level data may be data defining and configuring a given play activity, at least in part. The level data may e.g. comprise elements representative of programmed instructions, and values configuring the programmed instructions.

Advantageously according to some embodiments, each of the interactive toys further comprises a communications interface adapted to communicate with at least a further one of the interactive toys. Further advantageously according to some embodiments, the processing unit of at least a first one of the interactive toys is further configured to share configuration data representative of the configured set of programmed instructions with a second one of the interactive toys through the communications interface.

Further according to some embodiments, the toy system further comprises a configuration device; wherein the configuration devices comprises a first part adapted for holding one of the one or more interactive toys and a second part adapted for holding one of the one or more marker elements, and wherein the configuration device has a "READ ON" state and a "READ OFF" state, the "READ ON" state being adapted to facilitate detection of a marker held by the second part by an interactive toy held by the first part, and the "READ OFF" state being adapted to impede detection of a marker held by the second part by an interactive toy held by the first part. Thereby, a well-defined configuration procedure can be performed, which is reliably recognizable by the interactive toy. Thereby, a stable and reproducible configuration process is ensured.

Advantageously according to some embodiments, the toy system comprises a configuration device, wherein the configuration devices comprises: a base part; a first part adapted for receiving one of the one or more interactive toys, wherein the first part is moveable with respect to the base; and a second part adapted for receiving one of the one or more marker elements in a first position in proximity of the interactive toy for detecting the marker by the reader of the interactive toy. Thereby, a well-defined and controlled movement can be performed, which is easily and reliably identifiable by the interactive toy. Thereby a stable and reproducible configuration process is ensured. Examples of simple configuration movements are for example rotation around a pre-determined axis of rotation, which advantageously may coincide with a principal axis of a housing of the interactive toy when this is placed on the first part. Alternatively, a translation along a pre-determined path, such as a linear path is also conceivable as a simple and easy to implement configuration movement. However, it will be appreciated that other motion patterns, such as motion patterns that combine multiple rotational and/or translational movements to compose more complex configuration movements can be conceived. Alternatively or in addition thereto, also other types of movements may be used for creating a configuration movement as long as the movement can be recognized by the processing unit of the interactive toy to be configured, and attributed to a configuration setting. Examples of other types of movements may include vibrational movements, oscillatory movements, shaking movements, and translational movements along circular or otherwise curved paths.

Advantageously according to some embodiments of the toy system, the second part is moveable with respect to the first part between a first positon allowing for the detection of the marker, and a second position not allowing for the detection of the marker by the reader of the interactive toy. For example, when the interactive toy is placed on the first part and the marker element is placed on the second part, the marker is detectable when the second part is moved to the first position, and not detectable when moved the second part is moved to the second position. A change of detection status between detecting and not detecting the marker by the reader of the interactive toy can thereby be induced simply by moving the marker element between the first and second positions of the second part with respect to the interactive toy placed on the first part. The movement of the second part with respect to the first part may be any suitable movement, such as comprising one or more rotational and/or translational components.

It will be appreciated, that a detection status and a non-detection status as a consequence of the first and second positions of the second part, respectively, can also be achieved by other means. For example, the marker may be positioned in proximity of the interactive toy where the marker is detectable. The detection may then be prevented by a moveable element, e.g. the second part, acting as a shutter or as a similar blocking element inserted as an obstruction between the marker and the reader of the interactive toy, such that the marker cannot be detected by the reader of the interactive toy (second position of the second part). The detection position may then be recovered by removing the obstruction again (first position of the second part).

Thereby it is also possible to switch between the detection and non-detection of the marker element by the interactive toy. Thereby an easy switching of the detection status is achieved when both the interactive toy and the marker are placed on (or in) the configuration device.

Advantageously according to some embodiments of the toy system, the configuration device is a functional toy construction model constructed from toy construction elements of the toy construction system. Thereby, the educational and playful character of the user-configurable interactive toy and toy system is further enhanced. Furthermore, the configuration process is thereby further integrated in the playful development process of designing, constructing and re-constructing, configuring and re-configuring an interactive play experience for a constantly evolving play experience.

According to a yet further aspect, a configuration device for use in a toy system is disclosed whereby the analogue advantages are achieved as discussed elsewhere herein in relation to embodiments of the user-configurable interactive toy, and in relation to embodiments of the toy system comprising such an interactive toy. According to some embodiments, the configuration devices comprises: a base part; a first part adapted for holding one of the one or more interactive toys, wherein the first part is moveable with respect to the base; and a second part adapted for holding one of the one or more marker elements in a first position in proximity of the interactive toy for detecting the marker by the reader of the interactive toy. Further according to some embodiments, the first part is rotatable with respect to the base. Advantageously according to some embodiments of the configuration device, the second part is fixed with respect to the first part, or wherein the second part is fixed with respect to the base. Further according to some embodiments, the configuration device has a READ ON state and a READ OFF state, wherein the READ ON state is adapted to facilitate detection of a marker held by the second part by an interactive toy held by the first part, and wherein the READ OFF state is adapted to impede detection of a marker held by the second part by an interactive toy held by the first part. Advantageously according to some embodiments of the configuration device, the second part is moveable with respect to the first part so as to move the marker between the first position in proximity of the interactive toy for detecting the marker, and a second position at distance from the interactive toy for not detecting the marker by the reader of the interactive toy. The first position may be seen as a way of implementing the "ON" state. The second position may be seen as a way of implementing the "OFF" state. Alternatively or in addition thereto, a third element may be provided, which is a moveable element adapted to be inserted between the first and second part so as to obstruct detection of the marker by the interactive toy. The third moveable element may e.g. be implemented as a shutter, which may be closed to impede detection of the marker by the interactive toy. Other or further means may be provided for facilitating detection of the marker by the interactive toy when the configuration device is in the "ON" state, and for impeding detection of the marker by the interactive toy when the configuration device is in the "OFF" state. Further according to some embodiments, the configuration device is a functional toy construction model constructed from toy construction elements of the toy construction system. Thereby, the interactive play and the configuration is highly flexible and reconfigurable, and educational.

According to a yet further aspect, a method of configuring an interactive toy is disclosed whereby the analogue advantages are achieved as discussed elsewhere herein in relation to embodiments of the user-configurable interactive toy, and in relation to embodiments of the toy system comprising such an interactive toy. According to some embodiments, a method of configuring an interactive toy is provided, the interactive toy comprising:

- a reader for detecting a marker in a proximity of the interactive toy;
- a sensor for detecting movement of the interactive toy;
- a memory comprising programmed instructions and configuration data, wherein the programmed instructions are configured to control a response of the interactive toy to a detection of the marker, the response being defined at least in part by the configuration data;

a processing unit configured to execute the programmed instructions according to the configuration data when the processing unit is in a play state;

the method comprising the steps of:

entering a configuration state of the processing unit, responsive to a first trigger event indicative of a start of a configuration activity;

exiting the configuration state of the processing unit, responsive to a second trigger event indicative of an end of a configuration activity;

processing information about movements detected by the sensor while the processing unit is in the configuration state and/or information about markers detected by the reader while the processing unit is in the configuration state to determine a configuration input; and modifying the configuration data based on the determined configuration input.

It should be appreciated that the subject technology can be implemented and utilized in numerous ways, including without limitation as a process, an apparatus, a system, a device, a method for applications now known and later developed or a computer readable medium. These and other unique features of the system disclosed herein will become more readily apparent from the following description and the accompanying drawings.

BRIEF DESCRIPTION OF THE DRAWINGS

So that those having ordinary skill in the art to which the disclosed technology appertains will more readily understand how to make and use the same, reference may be had to the following drawings.

DETAILED DESCRIPTION

Figure 1:
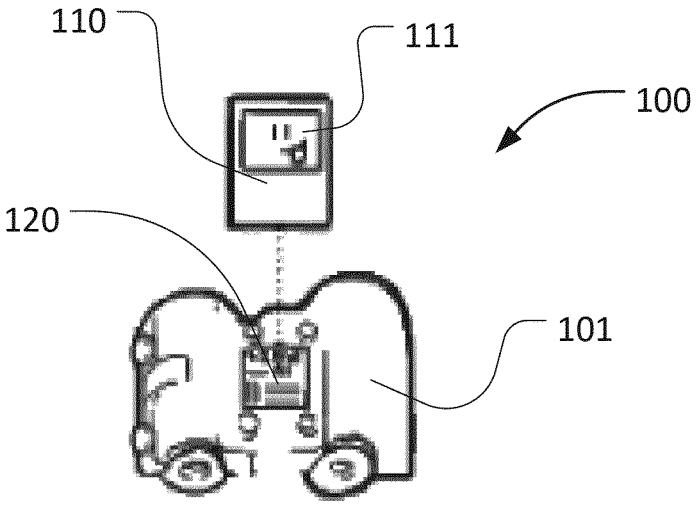
FIG. 1 a toy system comprising a vehicle and an interactive toy.

The subject technology overcomes many of the prior art problems associated with interactive toys. The advantages, and other features of the technology disclosed herein, will become more readily apparent to those having ordinary skill in the art from the following detailed description of certain preferred embodiments taken in con-junction with the drawings which set forth representative embodiments of the present technology and wherein like reference numerals identify similar structural elements. Directional indications such as upward, downward, right, left and the like are used with respect to the figures and not meant in a limiting manner.

FIG. 1 shows an example of a toy system 100 comprising a toy model 101, a marker element 120, and an interactive toy 110. The toy model 101 may be a toy construction model constructed from toy construction elements as known in the art of toy construction systems. The marker element 120 may be a marker construction element, which is compatible with the toy construction elements of the toy construction system. The interactive toy 110 comprises an accelerometer for detecting movements and an optical reader configured to detect different types of markers. One type of marker 120 includes a visual code, such as a microdot pattern, a bar code, a QR code or the like; while other markers are coloured tiles or other coloured toy construction elements. However, it will be appreciated that other types of markers, such as visible markers, RFID markers, etc., may be used. The interactive toy 110 resembles a character. In this example, the reader is facing downwards when the interactive toy is oriented for normal use, i.e. configured to detected markers onto or above which the interactive toy is placed. The normal orientation of the interactive toy may be defined by the shape of the toy (e.g. when resembling a figurine), the orientation of a display and/or in a similar manner. The interactive toy 110 further comprises a display and a loudspeaker for providing visible and audible feedback.

In the embodiment shown in FIG. 1, the marker construction element 120 is a part of the toy construction model 101 resembling a vehicle, e.g. one of a plurality of toy construction elements from which the toy construction model is constructed. Alternatively, the vehicle 101 may be formed from a single toy construction element including a marker 120. When the interactive toy 110 is placed in the vehicle 101, the interactive toy 110 detects the marker 120, and loads a set of programmed instructions for an interactive play activity associated with that marker 120.

Figure 2:
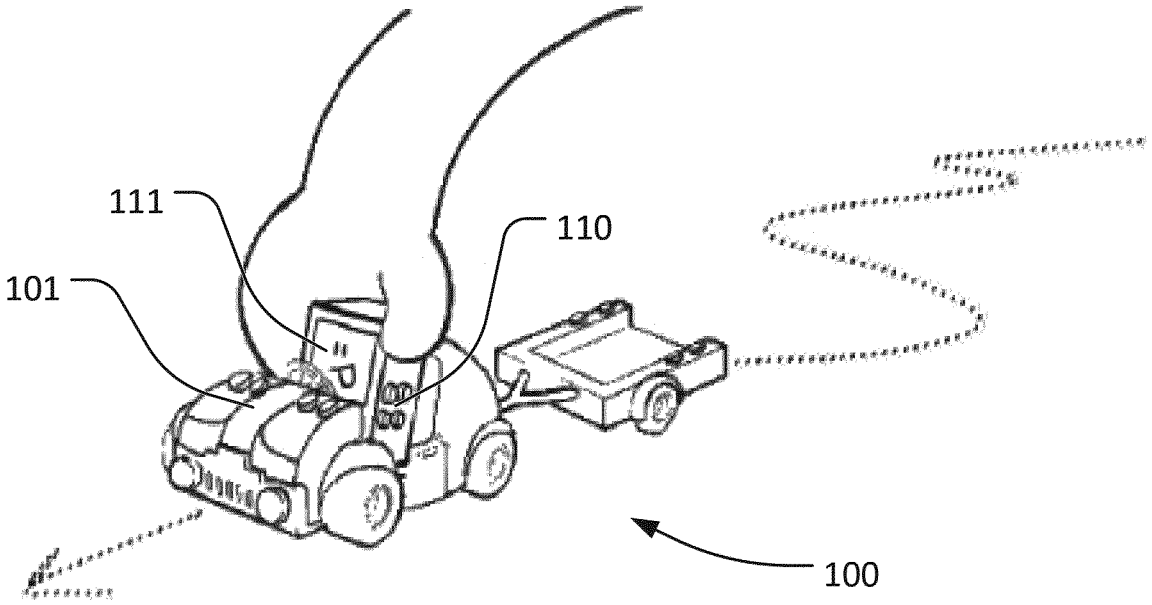
FIG. 2 a toy system comprising a vehicle and an interactive toy in an active play state.

FIG. 2 shows the vehicle 101 of FIG. 1 in a playing context, when the interactive toy is in an active play state. When the user moves the vehicle 101 with the interactive toy 110 around, the interactive toy 110 detects the movement of the car and creates audible and/or visible feedback responsive to the detected movements according to the loaded set of programmed instructions associated with the marker 120. The actual audible and/or visible feedback associated with the marker 120 may be configured beforehand, e.g. prior to entering the active play state. The configuration may be stored as configuration data for use in a set of programmed instructions, which is loaded for execution by the processing unit when the marker 120 is detected by the interactive toy, and when the interactive toy is in the active play state. Modifying the configuration for a given marker 120 allows to configure and re-configure the set of programmed instructions associated with the same marker 120 for a large variety of different interactive play activities. For example, the vehicle may be configured to become any type of vehicle, such as a police car, a race car, a truck with a heavy load, a speed boat, a helicopter, or an air plane. The corresponding visuals and sounds may be configured, and output by the interactive toy 110 through user interface 111 when the interactive toy 110 is in an active play state, as a feedback responsive to the user's physical interaction with the interactive toy 110 placed on the marker 120 in the vehicle 101.

Figure 3:
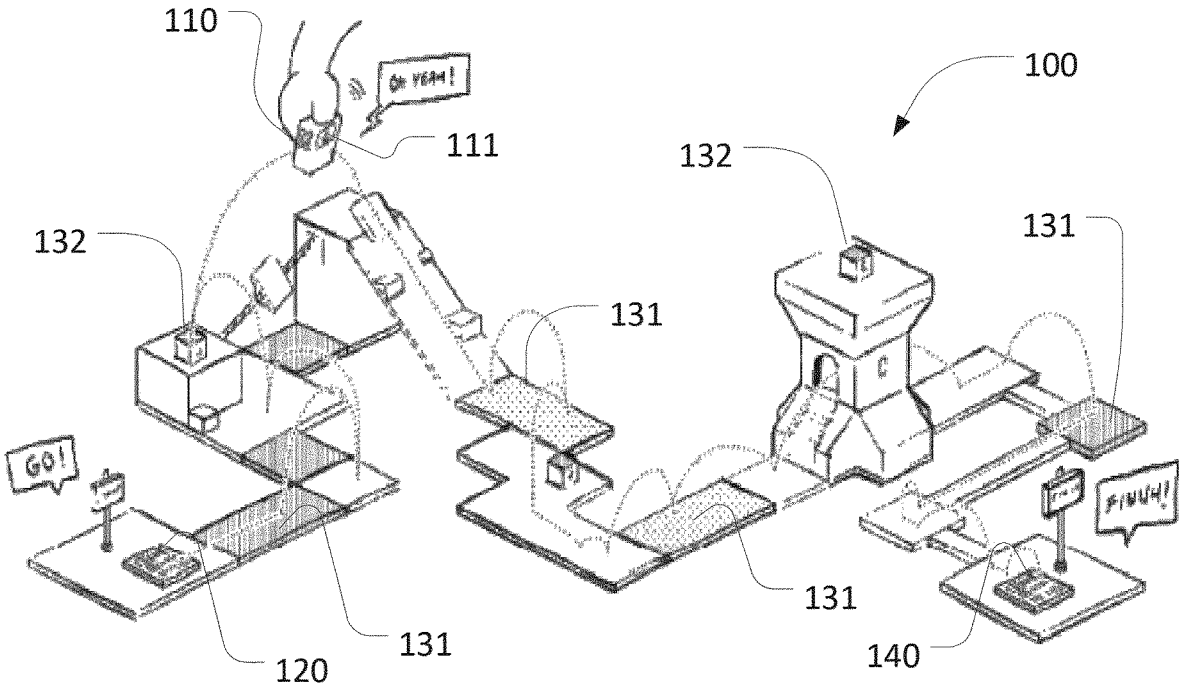
FIG. 3 a physical play environment comprising elements of a toy system and an interactive toy in an active play state.

FIG. 3 illustrates an example of a toy system, generally designated by reference numeral 100, the toy system comprises a physical play environment constructed from toy construction elements. The physical play environment includes "Start" and "Finish" patches with start and finish markers 120, 140, respectively. The physical play environment further comprises different types of markers 131 and 132 arranged in the physical play environment. The toy system further comprises an interactive toy 110 which a user can move about the physical play environment.

As described above, the interactive toy 110 comprises an accelerometer for detecting movements and an optical reader configured to detect markers: One type of marker 132 includes a visible code, such as a microdot pattern, a QR code or the like; while the other markers 131 are coloured tiles or other coloured toy construction elements.

However, it will be appreciated that other types of markers, such as visible markers, RFID markers, etc., may be used. The interactive toy 110 resembles a character. In this example, the reader is facing downwards when the interactive toy is oriented for normal use, i.e. configured to detected markers onto or above which the interactive toy is placed. The normal orientation of the interactive toy may be defined by the shape of the toy (e.g. when resembling a figurine), the orientation of a display and/or in a similar manner. The interactive toy 110 further comprises a user interface 111 with a display and a loudspeaker for providing visible and audible feedback.

The user initiates a play activity by holding the interactive toy in contact or close proximity to a start marker 120 so as to allow the optical reader to detect the start marker. Responsive to detecting the start marker, the interactive toy enters an active play state. In some embodiments, the toy system includes different start markers, each indicative of a respective type of play activity. Alternatively or additionally, different types of play activities may be selected based on other criteria, e.g. a user input to the interactive toy, communication with another interactive toy or with a processing device, based on previously completed play experiences, a progression level of the interactive toy, etc. A progression level may e.g. be stored by the interactive toy and/or by a remote processing device with which the interactive toy is communicatively connected.

Generally, while in the active play state, the interactive toy detects movements of the interactive toy and it detects one or more markers, e.g. toy construction elements having predetermined colour(s) or other visual markers, when the interactive toy is brought in proximity of said markers.

When the interactive toy detects a finish marker 140, the interactive toy exits the active play state and computes a result score which depends on the movements and markers that have been detected while the interactive toy was in the active play state.

It will be appreciated that the result score may be computed and updated in real time while the interactive toy is in its active play state or it may be computed once the interactive toy has exited the active play state. It will be appreciated that, in some embodiments of the toy system described herein, the interactive toy may be configured to create audible and/or visible feedback responsive to detected movements and/or responsive detected markers, e.g. during the play activity or even when no play activity has been initiated by detecting a start marker. i.e. when the interactive toy is not currently in an active play state. In such an embodiment, the interactive toy may be configured to operate in a free-play state instead. It will further be appreciated that the type of feedback and the rules and conditions for the creation of respective feedback may differ depending on which state the interactive toy is operated in, e.g. which active play state or free-play state.

The computation of the result score may be based on a set of game rules where different types of play activities may have different game rules associated with them.

The game rules may thus be stored by the interactive toy and/or by a remote processing device with which the interactive toy is communicatively connected.

The computation of the result score may further depend on one or more other parameters, such as an elapsed time between detection of the start marker and detection of the finish marker, on any recognized accessories attached to the interactive toy and/or the like.

Hence, the score depends on how the user moves the interactive toy about the play environment between the start and finish markers, i.e. on the movements and/or on the detected markers. For example, a user may use the same physical play environment as in FIG. 3, but the user may move the interactive toy 110 along a different path than the one shown in FIG. 3, thus resulting in a different result score.

Similarly, the computed result score also depends on the type of markers (e.g. on the colours of the toy construction elements from which the physical play environment is constructed) and/or from the relative positions of the markers.

It will be appreciated that the play environment may be in the form of a single coherent toy construction model where all parts of the model are interconnected with a single structure. In other embodiments, the play environment may include multiple separate structures that may be positioned independently of each other.

Generally, in one play activity, detection of one type of marker may cause a result score to be increased, or even decreased, by a certain value. e.g. by a predetermined, random or otherwise determined value. For example, the result score may reflect an amount of an in-game currency, e.g. symbolized by virtual coins, stars or other virtual items. Collected coins may be used in the game for achieving in-game advantages, e.g. for obtaining capabilities, unlocking new games, advancing in an existing game, etc.

In some embodiments, a play activity may have a maximum duration associated with it. For example, such duration may be implemented by requiring that the interactive toy detects the marker representing the end of the play activity within a certain period of time after detection of the marker representing the start of the play activity. In some embodiments, detection of one type of marker during the play activity may cause the maximum duration to be extended.

One type of marker may cause an effect of the result score only after repeated detection of said marker during the play activity, or otherwise an effect on the result score that depends on the number of times the marker has been detected during the play activity. For example, one type of marker may represent an enemy which has to be touched multiple times in order to be defeated, e.g. multiple times within a certain period of time. This activation may thus simulate an enemy toy figure that has a simulated health value. When hit (as simulated by the interactive toy detecting a marker attached to the enemy figure), the health value of the enemy is reduced. When the health value reaches a minimum threshold due to repeated "hits", the result score computed by the processing unit of the interactive toy may be increased.

Yet further examples include markers that have a random or chance effect on the result score. Yet further examples include markers whose effect on the result score depends on the duration of detection, i.e. on how long the interactive toy is in a sufficient proximity to the marker for the marker to be detected.

Yet further examples include markers whose effect on the result score depends on the order in which they are detected or otherwise on the combination of detection of multiple markers. For example, one marker may represent a key where detecting the marker represents the interactive toy picking up a key. Another marker may represent a locked item, e.g. a treasure chest, a door, etc. that can be unlocked when the marker is detected during a play activity, but only after the interactive toy has already detected the marker representing the key during the same play activity.

The response of the interactive toy 110 when interacting with the physical play environment, and/or with other interactive toys, while in a given play state, is defined by the set of programmed instructions loaded for execution in said play state. The set of programmed instructions thus determines the response of the interactive toy to the detected movements and/or detected markers according to the configuration data used by the set of programmed instructions. The programmed instructions may define any of the responses mentioned herein, such as relating to the computation of a result score, and/or relating to the user-perceptible output produced by the interactive toy. The responses to the detection of movements and/or markers 120, 131, 132, 140 may be defined on a general level, e.g. establishing a type of play activity upon detection of a start marker 120, such as defining a "race track" or "fairground" play activity. The responses may also be defined on a temporary level. e.g. modifying the play activity upon detection of a marker 131, 132 in the course of the play activity, such as defining a temporary "superpower state" doubling all scores, which may last for a pre-determined period of time or until another marker 131, 132 or an end marker 140 is detected. The responses may also be defined on a specific level, by defining specific responses to the detection of specific markers 131, 132, such as providing a specific user-perceptible output and/or modifying a skill level or a result score upon detection of the specific marker 131, 132.

The behaviour in terms of responses of the interactive toy 110 to the detection of movements and markers in the play state may be configured by configuring one, or more, or all of the programmed instructions in respect of markers 120, 131, 132, 140 to be used in the play activity. The configured instructions for a play activity may be provided as configuration data for use by a set of programmed instructions, which are executed by the interactive toy when operated in the corresponding play state. A large variety of different play activities may thus be created using the same toy set with one or more interactive toys 110 and one or more markers 120, 131 132, 140.

Configuration may include e.g. one or more of setting parameter values in pre-programmed instructions, selecting one or more pre-programed instructions, and/or selecting a sub-set of pre-programed instructions as discussed above. The configurable pre-programed instructions are typically programed beforehand and stored in the memory of the interactive toy and/or may be retrievable through a wired or wireless communications interface from an external source, such as from a local computing device connected to the electronic device, or from a network based service.

In a simple, advantageous embodiment, configuration in respect of a marker is setting a parameter value in a programmed instruction associated with the marker. The configuration will then modify the response to the detection of the marker in a play state, thus modifying e.g. a result score, a time duration available for performing an action or completing the play activity, a pace of the play activity, a skill, or a power level, as derivable from the detection of the marker during the play activity.

Figure 4:
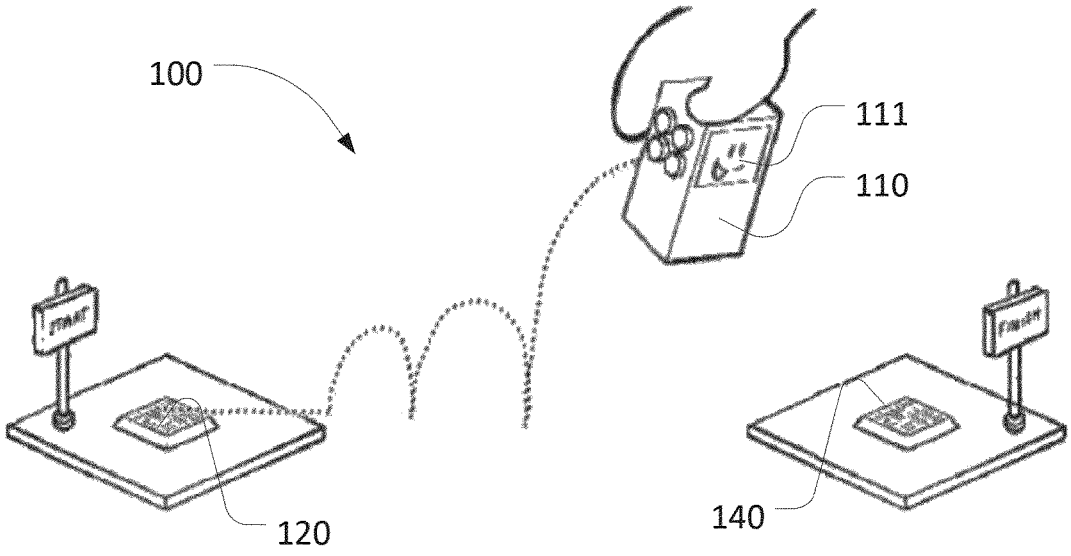
FIG. 4 a physical play environment comprising elements of a toy system and an interactive toy in an active play state.

FIG. 4 shows a yet further toy system including an interactive toy, and a physical play environment including "Start" and "Finish" patches with start and finish markers 120, 140, respectively. The toy system shown in FIG. 4 is similar to the system of FIG. 3. However, in the example of FIG. 4, the physical play environment only includes two markers, namely the start marker 120 and the finish marker 140 on respective "Start" and "Finish" patches. Hence, in this example, the score is computed solely based on the detected movements (and optionally based on elapsed time or other game parameters, e.g. a progression level, but not based on detected additional markers) while the interactive toy is in its active play state. i.e. between detecting the start marker and detecting the finish marker. Here, the play activity including responses to detected movements, as well as further game parameters may be configured with respect to the start marker, which then upon detection by the interactive toy for the activation of a play state also defines the details of the configured play activity.

Figure 5:
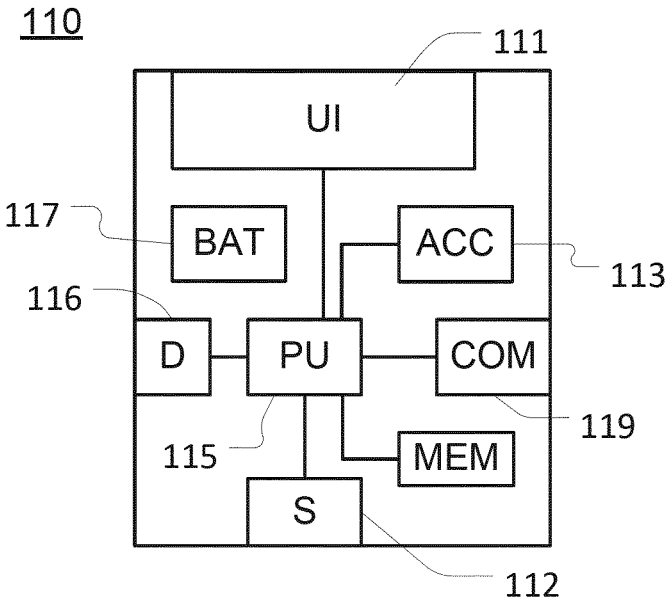
FIG. 5 a schematic block diagram of an interactive toy according to one embodiment.

FIG. 5 shows a schematic block diagram of an example of an interactive toy for a toy system as described herein. The interactive toy, generally designated by reference numeral 110, comprises a housing 118 accommodating the various electronic components of the interactive toy. The housing may be made from a suitable material, such as plastic. The housing may have a shape corresponding to the play experience. For example, the housing may resemble a toy figurine, a toy robot, a toy vehicle, a toy animal or another type of toy. The housing may have any suitable size, preferably such that it can conveniently carried and manipulated by a child.

The interactive toy 110 comprises a number of electronic components which may all be accommodated within the housing. In particular, the interactive toy comprises

- an accelerometer 113 or other type of sensor for detecting movement of the interactive toy;
- a reader 112 for detecting markers in a proximity of the interactive toy;
- a memory 114 comprising programed instructions;
- a configuration interface adapted to configure the programmed instructions; and
- a processing unit 115 configured to control the configuration interface responsive to a detected movement and a detected marker.

The accelerometer 113 may be a multi-axes accelerometer, such as a triaxial accelerometer or a 6-axis accelerometer so as to allow detection of movements in various directions and to at least approximately measure derived attributes of such motion, such as speed, direction, distinguish linear motion, rotational motion, reciprocating motion, impacts, etc.

The reader 112 comprises an optical sensor for detecting visual markers such as colour codes or individual colours. Alternatively or additionally, the optical sensor may be configured to detect insignia, bar codes, QR codes, microdot codes or other machine-readable codes or optically detectable and recognizable features. The optical sensor may comprise one or more colour sensors, e.g. an array of colour sensors. In some embodiments, the optical sensor comprises a camera. In alternative embodiments, the reader may comprise an RFID reader or a different type of readers for reading markers employing other types of detection mechanism.

The memory 114 may include an EEPROM, a RAM, a solid-state data storage device or another suitable data storage device. The memory may have stored thereon program code to be executed by the processing unit, configuration data to be used by the program code, and/or game-related data, such as information on game progression, previous result scores, etc.

The configuration may e.g. be performed by means of a process or software module implemented in the processing unit 115, based on programmed instructions stored in the memory 114.

The processing unit 115 may include a suitably programmed microprocessor or any other circuit and/or device suitably adapted to perform the data- and/or signal-processing functions described herein. In particular, the processing unit may comprise a general- or special-purpose programmable microprocessor, such as a central processing unit (CPU), a digital signal processing unit (DSP), an application specific integrated circuits (ASIC), a programmable logic arrays (PLA), a field programmable gate array (FPGA), a special purpose electronic circuit, etc., or a combination thereof.

The processing unit 115 is configured for operation in at least a configuration state and one or more play states, and optional further states, such as an idle state and/or low-power state. When operated in the configuration state, the processing unit 115 is configured to receive sensor data from the accelerometer 113 and from the reader 112 and to control the configuration interface. The interactive toy may thus be used in an interactive manner to configure responses of the interactive toy system to the detection of movement and markers for a play activity in a play state. In particular, the processing unit is configured to enter a configuration state responsive to a first trigger event indicative of a start of a configuration activity; exit the configuration state responsive to a second trigger event indicative of an end of a configuration activity; process information about movements detected by the sensor while the processing unit is in the configuration state and/or information about markers detected by the reader while the processing unit is in the configuration state, to determine a configuration input; and modify the configuration data based on the determined configuration input. Modifying the configuration data results in modified configuration data, thereby modifying the response of the interactive toy to a detection of the marker when the processing unit executes the programmed instructions in the play state.

When operated in a play state, the processing unit 115 is configured to receive sensor data from the accelerometer 113 and from the reader 112 and to control a user-interface 11 responsive to the received sensor data. In particular, the processing unit may implement a state machine where the processing unit can operate in an active play state, a stand-by state a free-play state, and/or the like as described herein and to compute result scores of play activities and/or generate user-perceptible outputs based on detected markers and movements.

In the present example, the electronic 110 toy further comprises a user interface 111, an accessory detector 116, a communications interface 119 and a battery 117. It will be appreciated, however, that other examples of an interactive toy may be implemented without these components or with only some of them.

Advantageously, however, a user-interface 111 for providing a user-perceptible output is present, and the processing unit 115 is configured to control the user-interface responsive to a detected movement and a detected marker. The user-interface 111 includes a display and an audio output. Alternatively or additionally, the user-interface may include other output devices for providing visual and/or audible and/or tactile output. The user-interface may further comprise one or more input devices allowing a user to provide user input. Such input devices may include physical input devices such as buttons, touch pads etc. or they may be provided as activatable user-interface elements provided by a touch-sensitive display or the like.

Similarly, some embodiments of an interactive toy may include alternative or additional components.

The accessory detector 116 may be configured to detect whether one or more accessories are attached to the interactive toy 110, e.g. items of clothing, decoration, gear or the like. The accessory detector may include an RFID reader, micro-switches, electrical contacts and/or the like. The processing unit may receive information about attached accessories from the accessory detector and further base the created output on the received information.

The communications interface 119 may be a wired or wireless interface, e.g. using RF communication such as Bluetooth LE or another suitable wireless or wired communications technology allowing the interactive toy to communicate with another interactive toy and/or with an external data processing device such as a tablet computer, a smartphone or the like.

The battery 117 may be a conventional battery, a rechargeable battery or another suitable energy storage device for providing the electronic components of the interactive toy with electric operating power.

Figure 6:
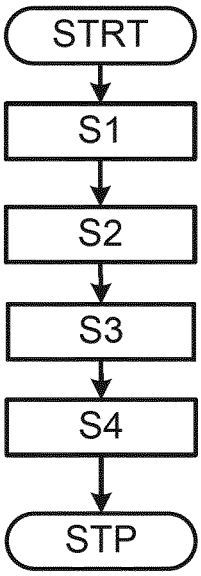
FIG. 6 a diagram of a method of configuring an interactive toy, according to one embodiment; and in FIGS. 7-10 a configuration device with an interactive toy in different stages of the configuration process.

FIG. 6 shows a flow diagram of an example of a process as described herein. In step S1, the interactive toy detects a first configuration trigger event causing the interactive toy to enter a configuration state. The first configuration trigger event is indicative of a start of a configuration activity. For example, the interactive toy may be in a pre-determined non-play state, such as a stand-by state, and detect a marker 131, 132 for in-game related events. From the context of the stand-by state the processing unit 115 infers a configuration trigger event indicating that the user intends to start a configuration activity, and enter the configuration state. The first configuration trigger event may also be the detection of a dedicated marker for configuration activities. In a yet further example of a first configuration trigger event, the interactive toy may detect a marker 120, 131, 132, 140, and in combination with detecting a marker also detect a movement, such as a shaking motion performed immediately before, during or immediately after the detection of the marker. Based on the combination of the detected marker and the detected motion the processing unit 115 infers a first configuration trigger event indicating that the user intends to start a configuration activity, and enters the configuration state. The interactive toy may also enter the configuration state triggered by the activation of a separate user interface input element.

In step S2, while in the configuration state, the interactive toy reads sensor data from the accelerometer and the reader and determines a configuration input responsive to the received sensor data. The interactive toy may further create audible and/or visible output responsive to the received sensor data, so as to provide the user with feedback indicative of the configuration activity performed.

In step S3, the interactive toy modifies the configuration data according to the determined configuration input to provide modified configuration data. The interactive toy stores the modified configuration data for use in a set of programmed instructions for execution in a corresponding play state.

In step S4, the interactive toy detects or receives a second configuration trigger event causing the interactive toy to exit the configuration state. The second configuration trigger event is indicative of an end of a configuration activity. For example, the second trigger may be the detection of a dedicated configuration activity marker. The second trigger event may also be that the marker in respect of which the interactive toy is to be configured is no longer detected. Yet further examples of other triggers include the expiry of a timer indicative of a maximum duration for a configuration activity, or of a maximum duration for not detecting further movements of the interactive toy after a configuration selection has been made. The interactive toy may also exit the configuration state triggered by the activation of a separate user interface input element.

Figure 7:
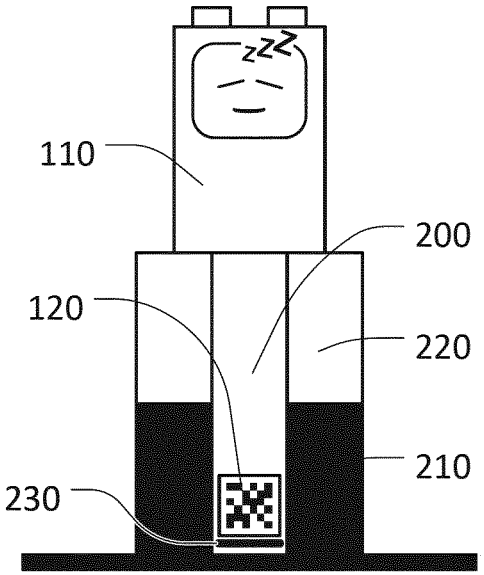
Figure 8:
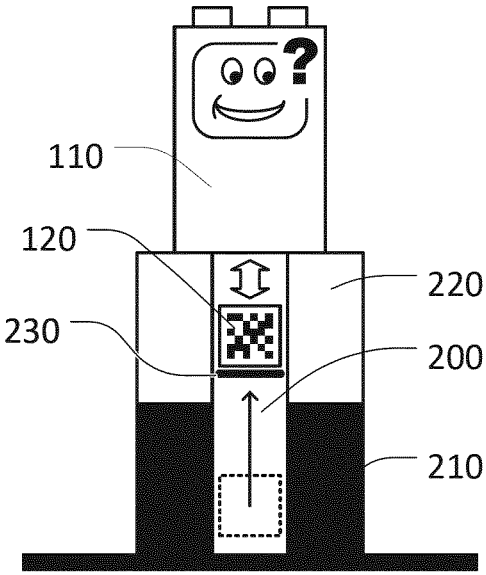
Figure 9:
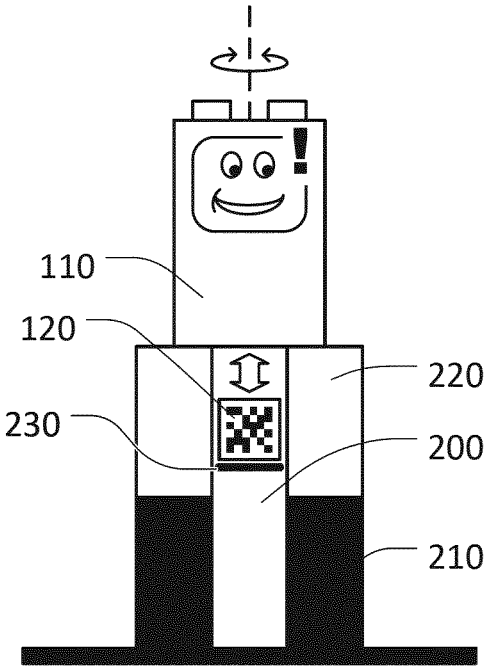
Figure 10:
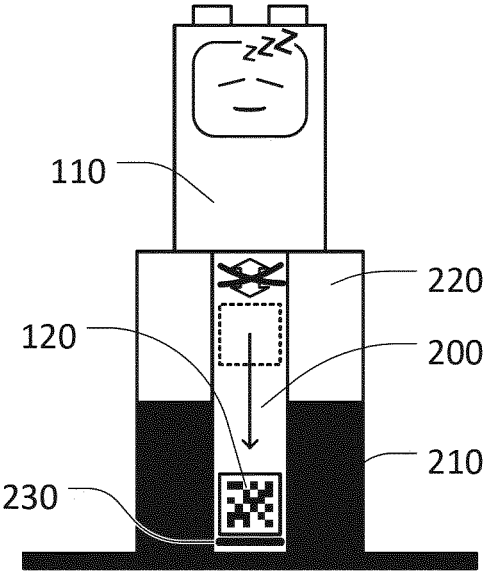

FIGS. 7-10 show a schematic example of a configuration device 200 that may be used for performing configuration activities on an interactive toy 110, illustrating different stages of the configuration process with respect to a marker element 120. The configuration device 200 has a base part 210, a first part 220 adapted for receiving the interactive toy 110, and a second part 230 adapted for receiving the marker element 120. The first part 220 is rotatable with respect to the base 210, thereby also rotating the interactive toy 110 placed on top of the configuration device 200 on the first part 220, around an axis of rotation R (as best seen in FIG. 9). The second part 230 is movable between a lowered position close to the bottom of the configuration device 200 and a raised position close to the top of the configuration device 200. In FIGS. 7 and 10 the second part is shown in the lowered position, and in FIGS. 8 and 9 the second part is shown in the raised position. A marker 120 placed on the second part may thus be moved from a position at distance from the interactive toy 110 to a position in proximity of the interactive toy, as schematically illustrated in FIG. 8, and also moved from the position in proximity of the interactive toy to the position at distance from the interactive toy, as schematically illustrated in FIG. 10.

In FIG. 7, the interactive toy 110 is in a pre-defined non-play state, such as a stand-by state, and may be awaiting activity, but monitoring e.g. reader data. However, with the marker 120 placed at distance the interactive toy does not detect the marker 120 and remains in the stand-by state. In FIG. 8 the user operates the second part 230 to bring the marker element 120 in a position in proximity of the interactive toy 110.

The interactive toy 110 detects the marker 120 by means of the reader of the interactive toy and awakes. From the context of the pre-defined state and the change in detection status of the marker element the interactive toy infers the start of a configuration activity and enters a configuration state. In FIG. 9 the user operates the first part 210 to rotate the interactive toy in a well-defined manner around the pre-determined axis of rotation R. Sensor data from the accelerometer sensor may then be received and analysed by the processing unit of the interactive toy to measure an angle of rotation. The angle of rotation may be mapped to determine a configuration input, e.g. mapping the measured angle of rotation to a parameter value, or to a selection of a particular configuration item. Based on the determined configuration input, the processing unit may then then provide and store modified configuration data for use in a set of programmed instructions for later use in a corresponding play activity involving the marker 120. In FIG. 10 the user operates the second part 230 to bring the marker 120 to the distant position where the interactive toy 110 no longer detects the marker 120. The interactive toy may use the change in detection status to determine the end of the configuration activities and exit the configuration state, and e.g. return to the stand-by mode. Upon receiving a proper trigger event indicating the start of a play activity, the interactive toy may then enter an active play state and respond to interactive play activities associated with the marker 120 according to the modified configuration data thus created. However, it will be appreciated that other trigger events involving user interaction and marker detection may be implemented in a configuration device to cause the interactive toy to enter and exit the configuration state, as also discussed above. Furthermore, while a rotational movement turns out to be a particularly useful for setting and/or selecting a configuration input, it will also be appreciated that other types of movements not restricted to rotation may be harnessed to indicate a configuration input. Such movements can include any mechanical interactions that can be measured by the movement sensor, such as an accelerometer and/or gyroscope, or the like, wherein the processing unit is configured to process the received sensor data to determine a configuration input from the detected movement.

It will further be appreciated that the configuration device may be a functional toy construction model constructed from toy construction elements of the toy construction system, thereby further enhancing the educational and playful character of the user-configurable interactive toy and toy system.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology as exemplified by the appended claims.

LIST OF REFERENCE NUMBERS

100 toy system
101 toy model
110 interactive toy
111 user interface
112 reader
113 movement sensor
114 memory
115 processing unit
116 accessory detector
117 battery
118 housing
119 communications interface
120, 131,
132, 140 marker elements
200 configuration device
210 base
220 first part
230 second part
S1-S4 steps of configuring an interactive toy

What is claimed is:

1. An interactive toy comprising:

a reader for detecting a marker in a proximity of the interactive toy;

a sensor for detecting movement of the interactive toy;

a memory comprising programmed instructions and configuration data, wherein the programmed instructions are configured to control a response of the interactive toy to a detection of the marker, the response being defined at least in part by the configuration data; and a processing unit configured to execute the programmed instructions according to the configuration data when the processing unit is in a play state, wherein the processing unit is further configured to modify the configuration data in response to a combination of a detection of the marker in a proximity of the interactive toy, and a detection of a movement of the interactive toy when the processing unit is in a configuration state.

2. An interactive toy according to claim 1, wherein the marker and the movement are detected within a predetermined temporal relation with respect to each other.

3. An interactive toy according to claim 1, wherein the marker and the movement are detected concurrently.

4. An interactive toy according to claim 1, wherein the interactive toy further comprises a user-interface for providing a user-perceptible output, wherein the processing unit is further configured to control the user-interface responsive to a detected movement and a detected marker.

5. An interactive toy according to claim 1, wherein the processing unit is further configured to:

enter the configuration state responsive to a first trigger event indicative of a start of a configuration activity;

exit the configuration state responsive to a second trigger event indicative of an end of a configuration activity; and process information about movements detected by the sensor while the processing unit is in the configuration state and/or information about markers detected by the reader while the processing unit is in the configuration state to determine a configuration input and modify the configuration data based on the determined configuration input.

6. An interactive toy according to claim 5, wherein the first trigger event includes detection by the reader of a marker element, when the interactive toy is in a pre determined operational state.

7. An interactive toy according to claim 5, wherein the first trigger event includes a change in detection status between detecting and not detecting a marker element, and/or wherein the second trigger event includes a change in detection status between detecting and not detecting a marker element.

8. An interactive toy according to claim 5, wherein processing information about movements detected by the sensor includes identifying a rotation about a predetermined rotation axis by a rotation angle associated with a configuration setting.

9. An interactive toy according to claim 5, wherein modifying the configuration data includes:

setting a parameter value;

selecting a programmed instruction from a plurality of programmed instructions, each of the plurality of programmed instructions corresponding to a respective response of the interactive toy to the detection of the marker when the processing unit is in the play state; and retrieving a sub-set of programmed instructions from a plurality of sub-sets of programmed instructions, each of the plurality of sub-sets defining a respective behavior of the interactive toy when the processing unit is in the play state.

10. An interactive toy according to claim 1, wherein modifying the configuration data provides modified configuration data, thereby modifying the response of the interactive toy to a detection of the marker when the processing unit is in the play state.

11. A toy system comprising:

a toy vehicle model having:

a marker disposed in an input of the toy vehicle model; and an interactive toy configured for insertion into the input of the toy vehicle model, the interactive toy having:

an optical reader configured to detect the marker;

an accelerometer configured to detect movement of the interactive toy;

an interface including a display and an audio output, the interface configured to output audible or visible feedback; and a processor configured to receive data from the optical reader and the accelerometer and control the interface responsive to the detected movement and the detected marker.

12. The toy system according to claim 11, wherein the processor is further configured to enter a configuration state indicative of a start of a configuration activity responsive to the optical reader detecting the marker, and exit the configuration state indicative of an end of the configuration state responsive to a change in a detection status of the marker by the optical reader.

13. The toy system according to claim 11, wherein the data received by the processor from the optical reader is indicative of a configuration input of the toy system.

14. The toy system according to claim 13, wherein processor is configured to modify the configuration input.

15. The toy system according to claim 11, further comprising an accessory detector configured to detect whether an accessory is connected to the interactive toy, the processor configured to receive data from the accessory detector and further control the interface responsive to the detected accessory.

16. A toy system comprising:

a toy vehicle model having:

an optical marker disposed thereon; and an interactive toy configured for insertion into the toy vehicle model, the interactive toy having:

an optical reader configured to detect the marker;

an accelerometer configured to detect movement of the interactive toy;

a memory comprising programmed instructions and configuration data, the programmed instructions configured to control a response of the interactive toy to a detection of the marker, the response being defined by the configuration data;

an interface including a display and an audio output, the interface configured to output audible or visible feedback; and a processor configured to receive data from the optical reader and the accelerometer and control the interface based on the programmed instructions according to the configuration data, the processor further configured to modify the configuration data in response to the detection of the marker and the detection of movement of the interactive toy.

17. The toy system according to claim 16, further comprising an accessory detector configured to detect whether an accessory is connected to the interactive toy, the processor configured to receive data from the accessory detector and further control the interface responsive to the detected accessory.

* * * * *